US006758148B2

(12) United States Patent
Torrey et al.

(10) Patent No.: US 6,758,148 B2
(45) Date of Patent: Jul. 6, 2004

(54) FIRE BLOCKING METHOD AND APPARATUS

(75) Inventors: Bruce Torrey, Orlando, FL (US); Neil Schultz, Katonah, NY (US)

(73) Assignee: Chep International, Inc., Orlando, FL (US)

( * ) Notice: Subject to any disclaimer, the term of this patent is extended or adjusted under 35 U.S.C. 154(b) by 220 days.

(21) Appl. No.: 10/045,696

(22) Filed: Oct. 26, 2001

(65) Prior Publication Data

US 2003/0079660 A1 May 1, 2003

(51) Int. Cl.[7] ..... B65D 19/00
(52) U.S. Cl. ..... 108/51.11; 108/57.25
(58) Field of Search ..... 108/51.11, 901, 108/902, 57.25, 57.27, 57.28, 161

(56) References Cited

U.S. PATENT DOCUMENTS

| | | | | |
|---|---|---|---|---|
| 3,581,681 A | * | 6/1971 | Newton | 108/57.28 |
| 3,661,099 A | | 5/1972 | Shelor | |
| 3,814,778 A | | 6/1974 | Hosoda et al. | |
| 3,921,279 A | * | 11/1975 | Daley | 29/458 |
| 4,440,708 A | | 4/1984 | Haataja et al. | |
| 5,123,359 A | * | 6/1992 | DelBalso | 108/57.27 |
| 5,462,903 A | | 10/1995 | Rousset et al. | |
| 5,528,994 A | | 6/1996 | Iseli | |
| 5,554,670 A | | 9/1996 | Giannelis et al. | |
| 5,590,606 A | | 1/1997 | Crews et al. | |
| 5,592,885 A | | 1/1997 | Young, Jr. et al. | |
| 5,636,577 A | | 6/1997 | Gow | |
| 5,687,652 A | * | 11/1997 | Ruma | 108/57.25 |
| 5,698,624 A | | 12/1997 | Becall et al. | |
| 5,766,681 A | | 6/1998 | Stoddart et al. | |
| 5,773,502 A | | 6/1998 | Takekoshi et al. | |
| 5,832,841 A | | 11/1998 | Crews et al. | |
| 5,840,796 A | | 11/1998 | Badesha et al. | |
| 5,845,588 A | * | 12/1998 | Gronnevik | 108/57.27 |
| 5,876,812 A | | 3/1999 | Frisk et al. | |
| 6,057,035 A | | 5/2000 | Singh et al. | |
| 6,123,032 A | * | 9/2000 | Ohanesian | 108/57.26 |

FOREIGN PATENT DOCUMENTS

| | | |
|---|---|---|
| DE | 38 25 219 A1 | 2/1990 |
| WO | WO-93/16927 A1 | 9/1993 |
| WO | WO 00/20495 | 4/2000 |

* cited by examiner

*Primary Examiner*—Jose V. Chen
(74) *Attorney, Agent, or Firm*—Akerman Senterfitt

(57) ABSTRACT

A pallet assembly includes at least one pallet member having external surfaces and a flame retardant material affixed to at least one pallet member so as to substantially cover all of the external surfaces of the pallet member. A pallet includes a container, tote bin, or any other suitable device used for the storage and transportation of items. In accordance with the invention, a method of fire blocking a pallet assembly includes the step of providing a pallet assembly that can include at least one pallet member having external surfaces. The method also can include affixing a flame retardant material to at least one pallet member so as to substantially cover all of the external surfaces of the pallet member.

21 Claims, 2 Drawing Sheets

FIRE BLOCKING METHOD AND APPARATUS

CROSS REFERENCE TO RELATED APPLICATIONS (Not Applicable)

STATEMENT REGARDING FEDERALLY SPONSORED RESEARCH OR DEVELOPMENT (Not Applicable)

BACKGROUND OF INVENTION

1. Technical Field

The present invention relates generally to fire blocking. More particularly, the invention relates to the fire blocking of pallets.

2. Description of the Related Art

Several approaches have been used to develop pallets with enhanced physical properties. Many of these approaches incorporate the use of various mixtures of compositions to enhance the physical properties of pallets. Specifically, these compositions attempt to increase flame resistance, durability, and strength of pallets. One type of composition that has been utilized includes nanocomposite technology. Nanocomposites utilize many different materials that are intermingled on a nanometer scale. The use of nanocomposites to develop high temperature compositions with enhanced thermal stability and performance characteristics is disclosed in U.S. Pat. No. 6,057,035 to Singh. The invention in Singh provides high-use temperature, lightweight polymer/inorganic nanocomposite materials utilizing techniques that enhance the thermal stability of the nanocomposite systems from their current limits of 100–150° C. to over 250° C. Additionally, much research has been focused on the development of flame retardant materials in combination with fabrics to provide flame retardant qualities. Combining flame retardant materials with fabric is generally known. For instance, U.S. Pat. No. 4,950,533 to McCullough, Jr. discloses fabrics comprising a blend of substantially permanently or irreversibly heat set, nonflammable, carbonaceous fibers with polymeric fibers. Considerable time and effort has been expended in commercial industry to develop nonflammable and flame retardant fabrics. In the area of pallet technology, the efforts have focused on increasing a pallet's ability to retard fire by the usage of methods involving the combinations of flame retardant materials in the composition of pallets, such as during the molding process. Additionally, the pallets in the prior art are monolithic in structure and incur difficulty when attempting to meet fire performance standards. Flame retardancy in the pallet industry is preferably measured according to the Underwriters' Laboratory UL-2335 and/or FMRC fire performance protocol. Other organizations, such as the Grocery Manufacturing Association (GMA) and OSHA impose size and other restrictions on pallets depending on its particular purpose. These standards set minimum requirements that ensure fire safety and performance in the pallet industry.

Unfortunately, past efforts conducted to develop pallets exhibiting superior flame resistance have been problematic. Difficulty has been encountered in attempting to qualify pallets under standard safety guidelines, such as UL-2335. The problem to be solved is in developing a warehouse material handling pallet that meets the endurance, dimensional, load bearing, and weight parameters outlined by the Grocery Manufacturers Association (GMA) and OSHA ergonomic requirements while meeting the Factory Mutual Research Corporation and Underwriters Laboratories, Inc. Standard UL 2335 fire performance protocols. Consequently, there is a need for a pallet structure that meets the standards under these regulatory test concerning flame retardancy, while remaining cost efficient and effective for its particular purpose.

SUMMARY OF INVENTION

The present invention relates to an apparatus and method of fire blocking a pallet assembly that enhances the physical attributes of the pallet assembly while providing flame retardancy.

A pallet assembly according to the invention comprises at least one pallet member having external surfaces and a flame retardant material affixed to at least one pallet member so as to substantially cover all of the external surfaces of the pallet member. A pallet can include a container, tote bin, or any other suitable device used for the storage and transportation of items.

In accordance with the invention, a method of fire blocking a pallet assembly comprises the steps of providing a pallet assembly that can include at least one pallet member having external surfaces. The next step can include affixing a flame retardant material to at least one pallet member so as to substantially cover all of the external surfaces of the pallet member.

In this invention, a flame retardant material provides a covering to the pallet member and increases the fire performance of the pallet assembly. The flame retardant material utilized can increase the overall safety of the pallet assembly while providing enhanced physical durability. Flame retardant material suitable for use in this invention can include a flame retardant fabric. Affixing the flame retardant fabric to the pallet assembly provides resiliency to open flames. Open flames and other heat sources are common causes of pallet meltdown, thus creating dangerous fire hazards during storage and transportation. Affixing the flame retardant fabric to a pallet protects and prevents damage resulting from fire related occurrences and normal wear and tear. A blend of polymeric fibers can be included in the flame retardant fabric. The flame retardant fabric can be adapted to the dimensions of the pallet member. Adapting the flame retardant material to the dimensions of the particular pallet member can permit individual components of the pallet member to be fabricated. The flame retardant material also can include a flame retardant liquid. The flame retardant liquid can comprise an intumescent material. The intumescent material can be applied to a pallet member using a brush, roller or spray similar to application of ordinary paint. Required coating thickness depends on the substrate, severity of the heat exposure, and level of protection desired. The flame retardant material utilized also can include a flame retardant polymer such as polyetaraflouraethylene. Flame retardant synthetic fibers such as polyolefin fiber also can serve as the flame retardant material. Polyester and melamine fibers can also be utilized as the flame retardant material on the particular pallet member. Additionally, the application of flame retardant materials can provide aesthetic value to a pallet along with providing pallet assembly protection and flame retardancy.

In an embodiment of the present invention the flame retardant material can include a flame retardant metal. Stainless steel, copper, and aluminum are examples of metals that exhibit strong heat resistance while maintaining malleability which allow these metals to be integrated into a pallet assembly. The flame retardant material also can utilize nanocomposite technology in covering a pallet assembly. Nancomposites utilize many different materials intermingled on a nanometer scale. Nanocomposites can be made from a variety of starting materials including, but not limited to gases, minerals, and plastics. Nanocomposite technology provides the benefit of increased physical properties. Nanocomposites can provide higher heat distortion temperatures, less shrinkage, less warping, electrical conductivity and better fire performance. The nanocomposites utilized in the flame retardant material can include an organic-inorganic complex of material. The flame retardant material can be composed of a nanocomposite material comprising a polymer material integrated with a clay between 0.1% and 20% by weight of the nanocomposite. The weight of the clay used in the nanocomposite comprising the flame retardant material also can include clay between 0.1% and 10% and clay between 10% and 20% by weight of the nanocomposite. The clay utilized can include a silicate or silicate derivative such as montmorillonite (alumino-silicate). Nanocomposite technology has demonstrated a significant reduction in heat release rates on the order of 50 to 75% while increasing stiffness, heat distortion temperatures, cold temperature impact and other barrier properties. Nanocomposites also can be utilized in conjunction with flame retardant resins. Flame retardant resins further enhance the fire resistance of pallets. Examples of fire performance enhancing resin technologies used are zirconia, boron oxides, polybenzoxazine, polymers and carbonsilicone resin additives.

The flame retardant material can be adhered to the pallet member utilizing a variety of processes well known within the industry. For example, in-mold processing, extrusion, co-extrusion, lamination, and autoclaving are available techniques that are suitable for adhering a flame retardant material to a pallet member. Application of flame retardant material to a pallet member is an effective mechanism for increasing the fire resistance of the pallet assembly and reducing accompanying safety hazards associated with low fire resistance, while also exceeding fire performance standards for pallets under Underwriters Laboratory UL 2335 protocol for pallets.

BRIEF DESCRIPTION OF THE DRAWINGS

The invention may be better understood by referring to the following description taken in conjunction with the accompanying drawings, it being understood, however, that the invention is not limited to the precise arrangements and instrumentalities shown.

DETAILED DESCRIPTION OF PREFERRED EMBODIMENTS

The present invention relates to an apparatus and method of fire blocking in a pallet assembly 10. The fire blocking of a pallet member 12 enhances the physical attributes of the pallet assembly 10 while providing flame retardancy.

A pallet assembly 10, according to the invention comprises at least one pallet member 12 having external surfaces 16 and a flame retardant material 14 affixed to at least one pallet member 12 so as to substantially cover all of the external surfaces 16 of the pallet member 12. A pallet can include a container, tote bin, or any other suitable device used for the storage and transportation of items.

In accordance with the invention, a method of fire blocking a pallet assembly 10 comprises the steps of providing a pallet assembly 10 that can include at least one pallet member 12 having external surfaces 16. The next step can include affixing a flame retardant material 14 to at least one pallet member 12 so as to substantially cover all of the external surfaces 16 of the pallet member 12.

Figure 1:
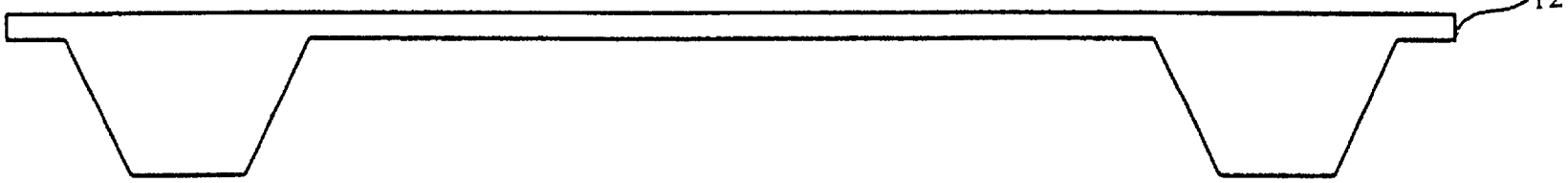
FIG. 1 shoes a front view of a pallet member without a flame retardant material.
Figure 2:
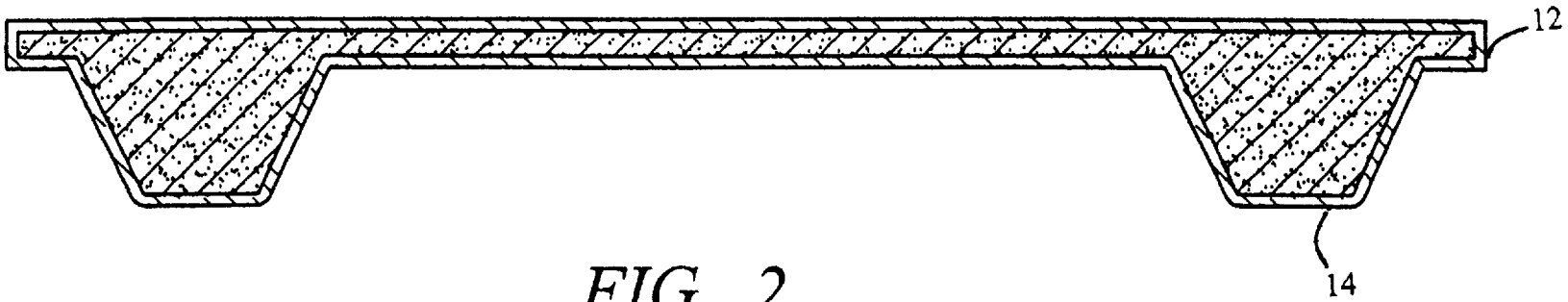
FIG. 2 shows a front view of a pallet member having a flame retardant material applied to pallet member.
Figure 3:
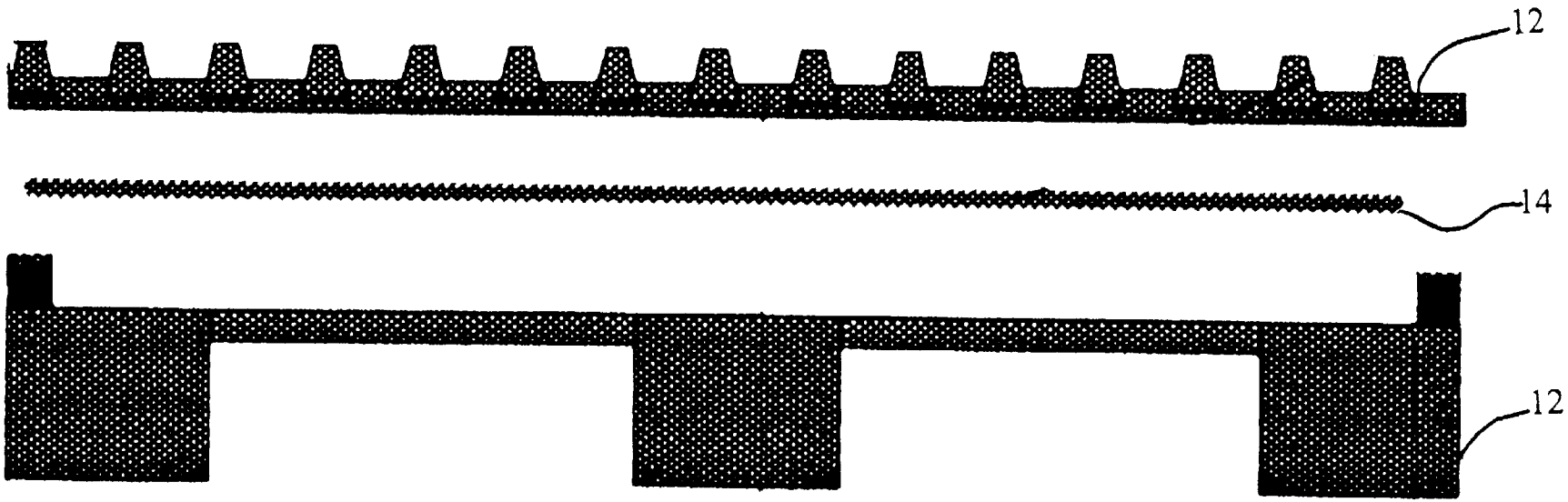
FIG. 3 shows a front view of a pallet member having a flame retardant material between surfaces of a pallet member.

FIG. 1 and FIG. 2 depict an embodiment of the present invention having a flame retardant material 14 being utilized to cover a pallet member 12. As shown in FIG. 2, the flame retardant material 14 is used to cover the surface of the pallet member 12. The type of flame retardant material 14 used in this embodiment is a flame retardant fabric 18. The flame retardant fabric 18 provides a protective covering for the underlying pallet member 12, as depicted in FIG. 2. Application of the flame retardant fabric 18 includes the preparation of a suitable flame retardant fabric 18 to meet the physical dimensions of the pallet member 12 or entire pallet to be covered. The individual components of the pallet member 12 can be fabricated individually or as an entire unit. For example, a pallet member 12 that has a lower surface and an upper surface can be entirely fabricated by covering both the lower and upper surface of the pallet member 12, as shown in FIG. 2. Alternatively, the lower surface can be fabricated while leaving the upper surface exposed, or the upper surface can be fabricated while leaving the lower surface exposed. Dependent on the particular use of the pallet member 12, it can be more suitable and economical to cover only one surface of a pallet member 12 with a flame retardant material 14. For instance, in a warehouse facility where stacking of pallets can be limited to single layer stacking, and the most likely fire hazard is presented from the ground or other lower surface, one may elect only to cover the lower surface of the pallet member 12. Flame retardant material used to cover a pallet member 12 can also include flame retardant resins within various components of the pallet member 12. For example, the upper surface of the pallet member 12 can include a flame retardant resin while the remaining portions, such as the lower surface, can comprise other materials. Other suitable flame retardant material can include flame retardant fabrics, films and gaskets. Flame retardant material, such as intumescent films, coatings and foams can be placed between the upper surface and lower surface of a pallet member 12 to provide additional flame resistance, as depicted in FIG. 3. Flame retardant material can also be placed to fill voids and spaces within the pallet member 12. Processes such as blow molding, welding, and twin sheet thermoforming can be utilized to incorporate the flame retardant materials into the pallet member 12.

Suitable types of flame retardant fabrics that can be utilized to cover a pallet member 12 can include fabrics comprising polymeric fibers and flame retardant polymers. A flame retardant polymer can include polytetrafluoroethylene. An example of a flame retardant polymeric fiber utilized can be a synthetic fiber. Synthetic fibers are engineered to transport and manage moisture, thermoregulate, stretch for comfort, provide personal safety, inhibit the growth of bacteria, and more. The weight of the flame retardant material 14 used can be an important factor to consider when designing a pallet assembly 10 to ensure meeting weight specifications for the particular pallet. As shown in FIG. 3, a flame retardant liquid 20 also can comprise the flame retardant material 14 used to cover the pallet member 12. For instance, intumescent materials can be provided as the flame retardant material 14. Covering a pallet member 12 utilizing the flame retardant liquid 20 can be applied with a brush, roller or spray similar to application of ordinary paint. The required coating thickness may depend on the substrate, severity of the heat exposure, and level of protection desired. For example, coating visually exposed pallet members 12 by spraying flame retardant intumescent paint directly to a pallet member 12 can be used where the pallet design calls for a thin, aesthetic, decorative look. The intumescent material 14 can be applied to a pallet member 12 and cause the surface to bubble to create a barrier between the fire and the treated material, thereby providing significant protection for the pallet member 12.

In an embodiment of the present invention, the flame retardant material 14 can include a layer of metal as a suitable flame retardant material 44. Stainless steel, copper, and aluminum are examples of metals that exhibit strong heat resistance while maintaining malleability which allow these metals to be integrated into a pallet assembly 10. In some pallet designs it may be advantageous to use metal as the covering material in the pallet assembly 10 because of the intended use of the particular pallet. For instance, many wooden pallets often deteriorate and fall apart over time and require constant maintenance. Consequently, wood might not be optimally suited to transport highly flammable cargo. However, in some circumstances, metal as the flame retardant material 14 in a pallet assembly 10 may provide an adequate level of fire retardancy to enable a wood pallet to be used. The thickness of metal layers applied to the pallet member 12 can be adjusted to suit the specific needs of the pallet, along with consideration to transportation and storage concerns.

The present invention can include nanocomposite technology as a component of the flame retardant material 14 utilized in covering a pallet member 12. Nanocomposites utilize many different materials intermingled on a nanometer scale. Nanocomposites can be made from a variety of starting materials including, but not limited to gases, minerals, and plastics. Nanocomposite technology provides the benefit of increased physical properties. Nanocomposites can provide higher heat distortion temperatures, less shrinkage, less warping, electrical conductivity and better fire performance. The nanocomposites utilized in the flame retardant material 14 can be incorporated into a variety of materials. Nanocomposites can comprise an organic-inorganic complex of material. The flame retardant material 14 can be composed of a nanocomposite material comprising a polymer material integrated with a clay between 0.1% and 20% by weight of the nanocomposite. The weight of the clay used in the nanocomposite comprising the flame retardant material 14 also can include clay between 0.1% and 10% and clay between 10% and 20% by weight of the nanocomposite. The clay utilized can include a silicate or silicate derivative such as montmorillonite (aluminosilicate). Nanocomposite technology has demonstrated a significant reduction in heat release rates on the order of 50 to 75% while increasing stiffness, heat distortion temperatures, cold temperature impact and other barrier properties. Nanocomposites also can be utilized in conjunction with flame retardant resins. Flame retardant resins further enhance the fire resistance of the pallets. Examples of fire performance enhancing resin technologies used are zirconia, boron oxides, polybenzoxazine, polymers and carbon-silicone resin additives.

The present invention can be useful in a protect various forms of the pallet assembly 10 that can include, but are not limited to warehouse pallets, totes, bins, and intermediate bulk containers. Additionally, the invention can be used in conjunction with a multitude of pallet designs of unlimited dimensions. The Grocery Manufacturing Association sets specific requirements for pallets that are used in the food and beverage industry. The Grocery Manufacturing Association (GMA) is one of the largest association of food, beverage and consumer product companies. The GMA assists in establishing food and nutritional policy throughout the country, which includes establishing pallet specifications. Pallet specifications as established by the Grocery Manufacturing Association require that a pallet be exactly 48"× 40"; have true 4-way entry; accommodate pallet racks; have a smooth, non-skid, top load bearing surface having at least 85% coverage and should be flat; a bottom loading surface and have cuts for pallet jack wheels from four sides; rackable from 48" and 40" dimension; must be recyclable; desired weight under 50 pounds; have a load capacity of 2,800 pounds; capable of bearing 2,800 pound loads safely in stacks of five loads high racking; and weather and moisture resistant. In an embodiment of the present invention featuring certain pallet designs, the pallets meet the Grocery Manufacturing Association requirements.

The flame retardant material 14 can be adhered to the pallet member 12 utilizing a variety of processes suitable in the industry. For example, in-mold processing, extrusion, co-extrusion, lamination, and autoclaving are available techniques that are suitable for adhering a flame retardant material 14 to a pallet member 12. Application of flame retardant material 14 to a pallet member 12 is an effective mechanism in increasing the fire resistance of pallets and reducing accompanying safety hazards associated with low fire resistance, while also exceeding fire performance standards for pallets under Underwriters Laboratory UL 2335 protocol for pallets.

What is claimed is:

1. A method of fire retarding a pallet assembly, said method comprising the steps of:

providing a pallet assembly comprising at least one pallet member having external surfaces; and affixing a flame retardant material to said at least one pallet member so as to substantially cover all of said external surfaces of said pallet member, wherein said flame retardant material includes a flame retardant fabric comprising a blend of polymeric fibers.

2. The method according to claim 1, wherein said affixing step further provides preparing said flame retardant fabric adapted to dimensions of said pallet member.

3. The method according to claim 1, further comprising the step of fabricating the individual components of said pallet member with said flame retardant fabric.

4. A method of fire retarding a pallet assembly, said method comprising the steps of:

providing a pallet assembly comprising at least one pallet member having external surfaces; and affixing a flame retardant liquid comprising an intumescent material to said at least one pallet member so as to substantially cover all of said external surfaces of said pallet member.

5. The method according to claim 4, wherein said flame retardant liquid is applied to the external surfaces of the pallet member a form selected from the group consisting of an intumescent film, coating end foam.

6. The method according to claim 1, wherein said flame retardant polymeric fibers comprise polytetrafluoroethylene.

7. A method of fire retarding a pallet assembly, said method comprising the steps of:

providing a pallet assembly comprising at least one pallet member having external surfaces; and affixing a flame retardant material including a flame retardant metal to said at least one pallet member so as to substantially cover all of said external surfaces of said pallet member.

8. The method according to claim 7, wherein said flame retardant metal is selected from the group consisting Of stainless steel, copper and aluminum.

9. A method of fire retarding a pallet assembly, said method comprising the steps of:

providing a pallet assembly comprising at least one pallet member having external surfaces; and affixing a flame retardant material composed of a nanocomposite comprised of a clay that includes a silicate derivative to said at least one pallet member so as to substantially cover all of said external surfaces of said pallet member.

10. A method of fire retarding a pallet assembly, said method comprising the steps of:

providing a pallet assembly comprising at least one a at member having external surfaces; and affixing a flame retardant material composed of a nanocomposite comprising a polymer material integrated with a clay to said at least one pallet member so a to substantially cover all of said external surfaces of said pallet member, said clay comprising between 0.1% and 20% weight of said nanocomposite.

11. The method according to claim 10, wherein said clay comprises between 0.1% and 10% weight of said nanocomposite.

12. The method according to claim 10, wherein said clay comprises between 10% and 20% weight of said nanocomposite.

13. A pallet assembly comprising:

at least one pallet member having external surfaces; and a flame retardant material affixed to said at least one pallet member so as to substantially cover all of said external surfaces of said pallet member wherein said flame retardant material includes a flame retardant fabric comprising a blend of polymeric fibers.

14. A pallet assembly comprising:

at least one pallet member having external surfaces; and a flame retardant material affixed to said at least one pallet member so as to substantially cover all of said external surfaces of said pallet member, wherein said flame retardant material includes a flame retardant liquid comprising an intumescent material.

15. The pallet assembly of claim 13, wherein said flame retardant polymeric fibers comprise polytetrafluoroethylene.

16. A pallet assembly comprising:

at least one pallet member having external surfaces; and a flame retardant material including a flame retardant metal affixed to said at least one pallet member so as to substantially cover all of said external surfaces of said pallet member.

17. The pallet assembly of claim 16, wherein said flame retardant metal is selected from the group consisting of stainless steel, copper and aluminum.

18. A pallet assembly comprising:

at least one pallet member having external surfaces; and a flame retardant material affixed to said at least one pallet member so as to substantially cover all of said external surfaces of said pallet member, wherein said flame retardant material is composed of a nanocomposite comprised of a clay that includes a silicate derivative.

19. A pallet assembly comprising:

at least one pallet member having external surfaces; and a flame retardant material affixed to said at least one pallet member so as to substantially cover all of said external surfaces of said pallet member, wherein said flame retardant material is composed of a nanocomposite material comprising a polymer material integrated with a clay, said clay comprising between 0.1% and 20% weight of said nanocomposite.

20. The pallet assembly of claim 19, wherein said clay comprises between 0.1% and 10% weight of said nanocomposite.

21. The pallet assembly of claim 19, wherein said clay comprises between 10% and 20% weight of said nanocomposite.

* * * * *

UNITED STATES PATENT AND TRADEMARK OFFICE

CERTIFICATE OF CORRECTION

PATENT NO. : 6,758,148 B2
DATED : July 6, 2004
INVENTOR(S) : Torrey et al.

It is certified that error appears in the above-identified patent and that said Letters Patent is hereby corrected as shown below:

The listing after the Abstract should read -- 23 Claims, 2 Drawings --.

Column 5,
Line 19, delete "44".

Column 6,
Line 64, insert -- in -- after "member".
Line 65, replace "end" with -- and --.

Column 7,
Line 24, replace "a at" with -- pallet --.

Column 8,
Line 44, insert claim 22 -- The method according to Claim 9, wherein said clay comprises montmorillonite --.
Line 45, insert claim 23 -- The pallet assembly of Claim 18, wherein said clay comprises montmorillonite --.

Signed and Sealed this

Eleventh Day of April, 2006

JON W. DUDAS
*Director of the United States Patent and Trademark Office*